US007587847B2

(12) United States Patent
Lasher

(10) Patent No.: US 7,587,847 B2
(45) Date of Patent: Sep. 15, 2009

(54) FRONT LOADING PICTURE FRAME

(76) Inventor: William Lasher, 2097 Dogwood Dr., Scotch Plains, NJ (US) 07076

( * ) Notice: Subject to any disclaimer, the term of this patent is extended or adjusted under 35 U.S.C. 154(b) by 1248 days.

(21) Appl. No.: 10/835,706

(22) Filed: Apr. 30, 2004

(65) Prior Publication Data

US 2005/0016045 A1 Jan. 27, 2005

Related U.S. Application Data

(60) Provisional application No. 60/467,300, filed on May 2, 2003.

(51) Int. Cl.
*G09F 15/00* (2006.01)

(52) U.S. Cl. ..... 40/611.01; 40/759; 40/713

(58) Field of Classification Search ..... 40/713, 40/781, 611.01–611.05

See application file for complete search history.

(56) References Cited

U.S. PATENT DOCUMENTS

| | | | | |
|---|---|---|---|---|
| 586,120 | A * | 7/1897 | Flynn | 40/713 |
| 1,573,264 | A * | 2/1926 | Mankameyer | 40/611.03 |
| 4,212,123 | A * | 7/1980 | Robin | 40/713 |
| 4,583,309 | A * | 4/1986 | Kane et al. | 40/711 |
| 4,912,863 | A * | 4/1990 | Harvey | 40/730 |
| 5,353,536 | A * | 10/1994 | Erber et al. | 40/606.1 |
| 5,778,582 | A * | 7/1998 | Rath | 40/611.03 |
| 2002/0083628 | A1 * | 7/2002 | Magid | 40/308 |

* cited by examiner

*Primary Examiner*—Cassandra Davis
(74) *Attorney, Agent, or Firm*—William J. Sapone; Coleman Sudol Sapone P.C.

(57) ABSTRACT

A picture frame assembly has a base mountable on a wall or other surface having a recess for receiving a cover sub assembly containing a picture therein. The base has integral components for leveling the base using a plumb line during fixing of the base to a wall or other surface to assure precise positioning before the cover sub assembly is mated to the base, to provide a front loading frame.

20 Claims, 11 Drawing Sheets

FRONT LOADING PICTURE FRAME

CROSS REFERENCE TO RELATED APPLICATIONS

This application claims priority in U.S. Provisional Patent Application Ser. No. 60/467,300 filed May 2, 2003

TECHNICAL FIELD

This invention relates to picture frames for mounting on walls and more particularly to a picture frame that has means to easily straighten and attach a base to a wall, prior to receiving a picture assembly on a front portion thereof.

BACKGROUND

A typical picture frame is designed to hang on a wall and usually has means to engage a hanger such as a nail or hook driven into the wall. The frame and a picture are usually assembled together from the back prior to mounting. Then, a hook, nail or other hanging device is attached to the wall at a desired location, usually chosen to be hidden behind the frame to maintain an aesthetic appearance. A wire for suspending the frame may be strung across the frame back to engage the hanging device. Otherwise, the frame may be fitted with one or more clips that slip fit onto one or more wall mounted hangers, as shown for example in U.S. Pat. No. 3,707,053.

The problems with these systems are that it is difficult to assure that a picture is at the correct height and level when placed on the wall and that it will remain level over time. With wire mounting, the frame may not remain flush with the wall and, through vibration, may slide on the wire. Also the degree of slack in the wire may cause the picture to hang too low or too high, requiring the hanging device to be pulled from the wall and repositioned. The difficulty with clips is that precise positioning is difficult, usually requiring several attempts at locating the wall mounted fasteners so these are both precisely level and at the correct location for engaging the frame mounted clips. These procedures take time and often results in multiple holes being placed in the wall.

In U.S. Pat. No. 5,230,172, a picture frame has means to mount pictures on opposite sides thereof, so that it can be free standing. Alternately, the frame can be wall mounted prior to receiving a picture and a face member. However, the problems with mounting and leveling the frame remain.

In U.S. Pat. No. 6,354,031, a device for displaying documents has a back panel attached to a wall, receiving a frame with a corresponding shaped recess thereover so that the frame can be mounted thereon and held in place by flexing elements.

In U.S. Pat. No. 5,353,536, a display assembly for signs or posters utilizes a similar rear member that is wall mounted, with a frame secured thereover that interlocks the frame and rear member together. A foam backing is used to compress a poster against a front surface of the frame.

None of these frame designs provide ease in mounting a picture frame to a wall with additional ease in precise frame leveling. The search thus continues for a picture frame assembly that is easy to level and mount to a wall, but also has the ability to change the picture, without removing the frame from the wall.

SUMMARY OF THE INVENTION

It is an object of the present invention to provide a picture frame having integral means for assuring level mounting.

It is further object to provide means for front loading pictures into a picture frame assembly, so that pictures and frame types may be readily changed without disturbing the placement on the wall.

It is a further object to provide a picture frame having means for easily locating, mounting and removing a picture frame from a wall.

These and other objects of the present invention are achieved by a picture frame assembly comprising a wall mounting base having means for receiving a cover assembly on a front portion thereof, and having raised spacer means extending upwardly from a surface of the base, at least one raised spacer means having a hole therethrough for receiving a fastener therein, the base having at least one set of vertical indicator means integral with the surface, plumb means connectable to the base in proximity to the vertical indicator means so that the base can be tilted to align the plumb means with the vertical indicator means prior to fixing the base to the wall.

A cover assembly is mounted within a recess in the base. The cover assembly comprises a border surrounding a transparent front surface, and having a downwardly extending side wall received within a recess within the base. A backing wall is removably attached to the border for sandwiching a picture between the backing wall and the transparent surface.

In a preferred embodiment, a decorative frame border is integral with either the cover assembly or with the base. If integral with the cover assembly, this would allow changing the displayed picture as well as the style of frame assembly, without disturbing the position of the base on the wall. Alternatively, if integral with the base, the displayed picture could be changed without altering the aesthetic appearance of the frame.

Preferably, the picture assembly is press fit into the recess in the base after the base has been mounted and leveled.

DETAILED DESCRIPTION OF THE INVENTION

Figure 1A:
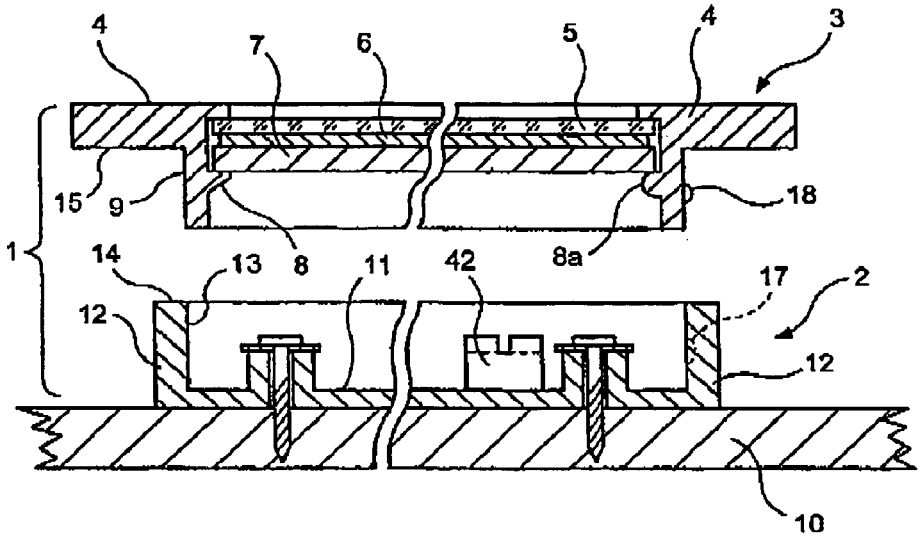
FIG. 1*a* is an exploded view of a picture frame assembly in accordance with the present invention.

Referring to FIG. 1*a*, a front-loading picture framing and mounting assembly 1 according to the present invention is shown. The assembly 1 has two parts, a base 2 and a cover sub-assembly 3.

The cover assembly 3 has a border 4 surrounding a transparent plate 5, beneath which a picture 6 or other display material is located. A backing wall 7, held in place by clips 8, holds the picture against the transparent plate, as in conventional picture frame assemblies, though other means for holding the display material with the plate may be used. However the cover sub assembly further has a downwardly projecting wall 9, whose purpose will be discussed further below.

The assembly 1 may be used for the display of photographs, artwork, engravings, and other graphic or printed material, which may include but are not limited to posters, artwork, booklets and magazines.

The cover subassembly 3 is removably attached to the base 2 preferably by a friction fit, though several alternative attachment methods may be used. This allows the cover sub assembly to be easily removed from the base from time to time, so that the displayed material can be quickly replaced with other material, while the base remains fixed to the wall. The base 2 has means for ease in level mounting to a wall, perfectly straight and level, and also in perfect alignment if two or more frames are used in a group. This may be accomplished by a totally unskilled and inexperienced person, without assistance and without special tools. This avoids any guesswork as to where the frame will end up, as occurs with conventional frames when a picture hook is nailed up first. Once the base is fixed to the wall, the cover subassembly is inserted into the base to complete the assembly. Two-point mounting preferably is used to fix the base to the wall so there is no shifting or sliding and the frame remains perfectly level over time. The base is first fixed in place while held on the wall surface, at the selected height by driving in one fastener. An integral plumb line incorporated with the base guarantees that the frame can then be lined up perfectly vertical by reference to integral cross hairs before the second nail is driven in.

The picture frame assembly may be made in any shape, such as but not limited to, round, oval, square or rectangular, and may be used in any application where a conventional picture frame is used. The frame assembly may be made of plastic, wood, glass, metal or other materials, or a combination of some or all of these. Preferably, injection-molded plastic will be used to make all or a portion of the base and/or cover subassembly, or at least the structural portions thereof. The base or cover subassembly border may incorporate wood pieces to surround the perimeter for aesthetic purposes. The cover subassembly has a flat transparent plate, made of glass or plastic, located over the displayed material as found in most conventional frames. A border surround the plate and may support the plate and/or displayed material. Fillets of a gold or silver colored metal or other decorative elements may be applied to enhance the appearance of the assembled frame. Decorative strips of material may be added, either in the course of manufacture or, can be provided as part of an accessory kit to the purchaser, so that the purchaser can personalize the frame for example by adding metallic or color accents.

Referring again to FIG. 1*a*, the base 2 forms the back of the frame assembly. The base 2 is flush with a wall 10 when it is wall-mounted, though it may be adapted for table or desk use. The base has a bottom 11 which may be a solid flat sheet or may have open areas to lessen material use. An upright wall 12 forms a perimeter of the base, having an inner surface 13 which engages the downwardly projecting wall 9 of the cover subassembly.

Figure 1B:
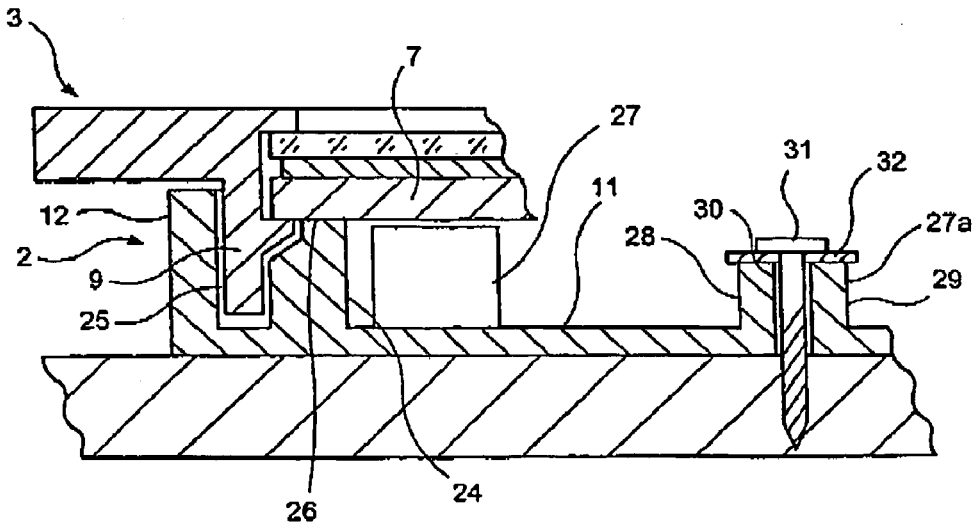
FIG. 1*b* is a sectional view of an alternative embodiment thereof.
Figure 1C:
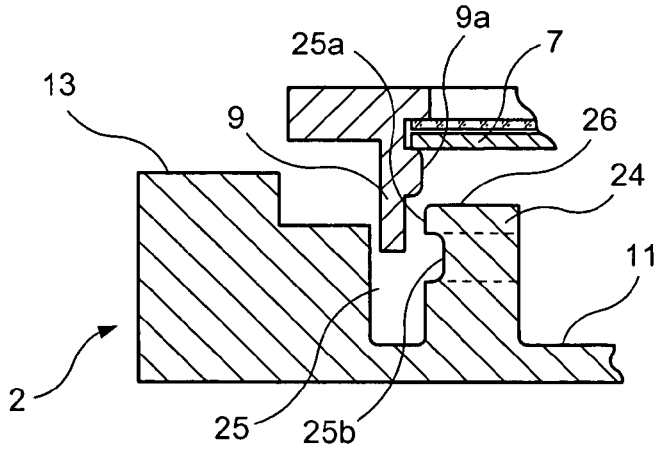
FIG. 1*c* is a cross sectional view of the assembled components.
Figure 1D:
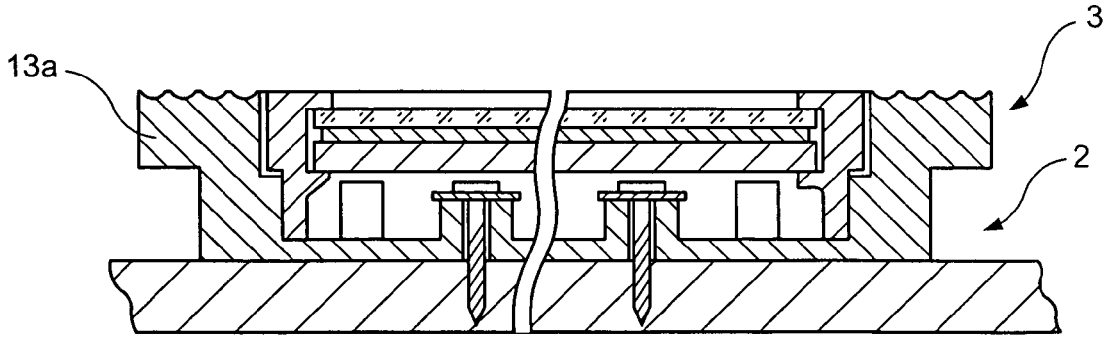
FIG. 1*d* is a view of the picture frame mounted on a wall with the decorative border integral with the base.

While in FIG. 1*a*, the upright wall 12 is hidden beneath the border 4, the upright wall may be formed in such a way as to support a decorative edge of the fame itself as shown in FIG. 1*d*, preferably with molded contours 13*a* such as may suggest four joined mitered pieces similar to conventional frames or other decorative shapes. Alternatively, materials such as actual joined wooded pieces may be attached by gluing of other means to the upright wall 12 to decorate the visible border that surrounds the delayed picture.

Figure 2:
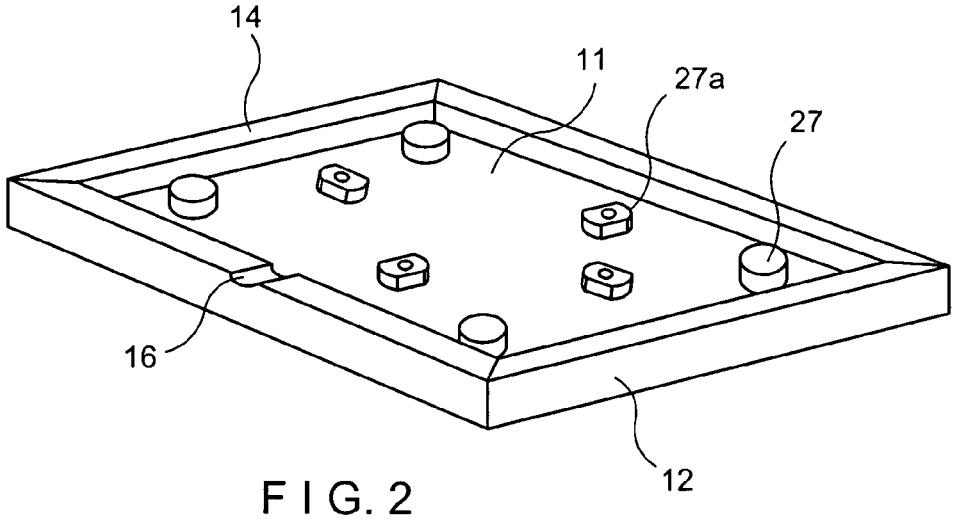
FIG. 2 is a perspective view of the picture frame base portion.

The upright wall 12 has a top surface 14 which is substantially flat all around, forming a plateau that may be about 8 to 13 mm wide before dropping down to an inside bottom of the base. The top surface receives thereon a bottom surface 15 of the cover subassembly. A slight depression 16 best seen in FIG. 2 is optionally provided either in the top surface 14 or the bottom surface 15 to permit a tool or fingernail to wedge beneath for removal of the cover subassembly.

The inner surface 13 optionally has a plurality of openings or indentations 17 for receiving projections 18 which extend from the downwardly projecting wall 9 to permit positive engagement of the cover assembly to the base. Of course, the indents and projections could be included on the downward wall and upright wall, respectively, as well, so long as they are in relative alignment for engagement, preferably being evenly spaced around the perimeter. Of course, other engagement means may also be used. These could include matable magnets or Velcro™ patches, which engage each other when the cover subassembly is mated to the base, but which allow for removal of the cover subassembly from the base without disturbing the placement of the base on the wall, so that the cover assembly would be removably fixed in place in a secure mounting.

From one to twelve such mating engagement means may be located around the perimeter of the base-cover assembly. This arrangement may be made either in addition to, or in lieu of, any other engagement method. Similar projections 8*a* could also be used in place of the clips 8 in the cover to hold the edges of the display material.

Figure 3:
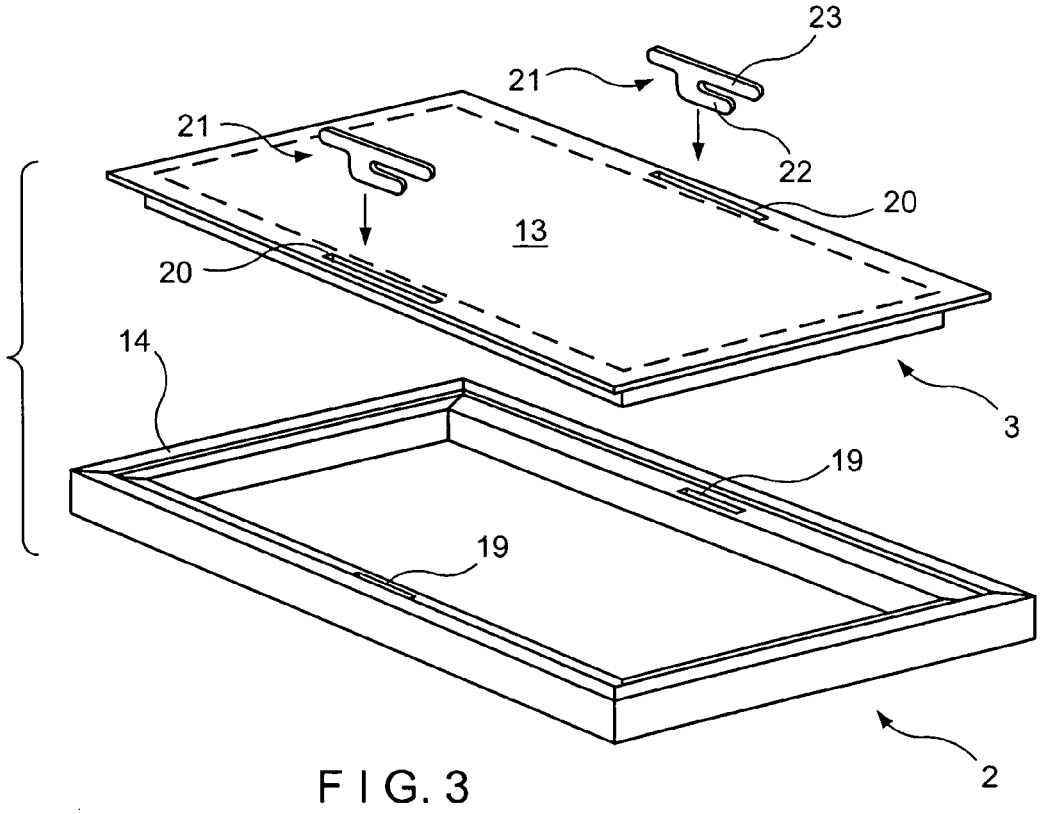
FIG. 3 is an exploded view of an alternative embodiment of the invention.

Another mounting system is shown in FIG. 3. A slot 19 is provided in the top surface 14 preferably on each of two opposite sides of the base 2. The slots are parallel and aligned with corresponding slots 20 located in the border 13, so that when the cover subassembly is placed on the base, a connector 21 shaped like an "h" or a "w"-passes through the mated slots to fasten the base and cover together. A small leg 22 of the connector is placed in the mated slots, and by sliding the longer leg 23 of the connector downward or sideways, the small leg of the connector lodges itself on the inside area beneath the top surface 14 of the base.

The slots and the small leg of the connector are configured to permit the outside, visible portion of the connector, i.e. the longer leg 23, to completely fill and cover the slot 20 on the cover to avoid distracting from the aesthetic appearance of the frame, coordinating with the cover and any decoration on it.

In an alternative embodiment, shown in FIG. 1*b*, a flat-topped ridge 24 rises straight up from the bottom 11 of the base 2 that extends parallel with the upright wall 12. A space between the wall and ridge forms a groove 25 around the base. The downward projecting wall 9 is received in the groove 25 when the cover and base are joined together. The groove need not be continuous, but should be of sufficient length to form a friction fit with the cover subassembly, if that is the method of releasable engagement chosen for use with the frame assembly.

The ridge 24 forms a support for the displayed material in the frame. Preferably, the ridge has a flat top 26 that may be approximately 10-20 mm wide.

The interior of the base contains a plurality of upright columns 27 having the same height as the ridge to similarly support the displayed material. In one embodiment of the invention, two or more columns 27*a*, have a pair of opposed flat side surfaces 28 and 29 and a central bore 30 that extends through the column and base, leading to the wall surface on which the base will be mounted. The columns 27*a* rise out of the bottom up to a height of about 2 mm lower that the ridge height and are used for wall mounting by receiving fasteners 31 for attaching the base to a wall. Each bore 30 optionally may have a rigid sleeve to hold and keep straight the fastener received therein.

Figure 4:
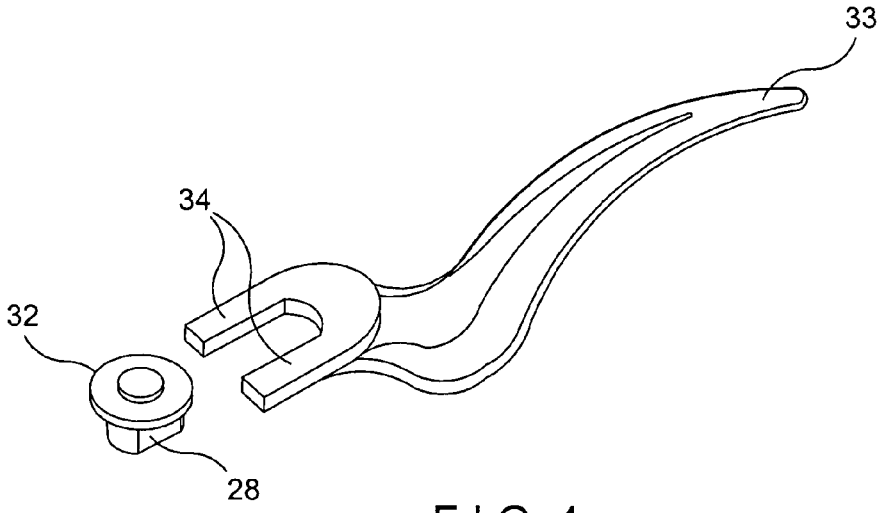
FIG. 4 is a view of the column fastener removal assembly.

Preferably, the fastener is placed in the bore 30 after a round washer 32 is added, the washer received on a top of the column extending beyond the flat surfaces 28 and 29. As shown in FIG. 4, this permits quick removal of the fastener by a slotted lever 33 having curved prongs 34 that fit in proximity to the flat sides. The prongs are located beneath the washer 32, and rise up along the flat surfaces 28 and 29, to engage the washer for lifting the fastener for disengagement from the wall.

Figure 5:
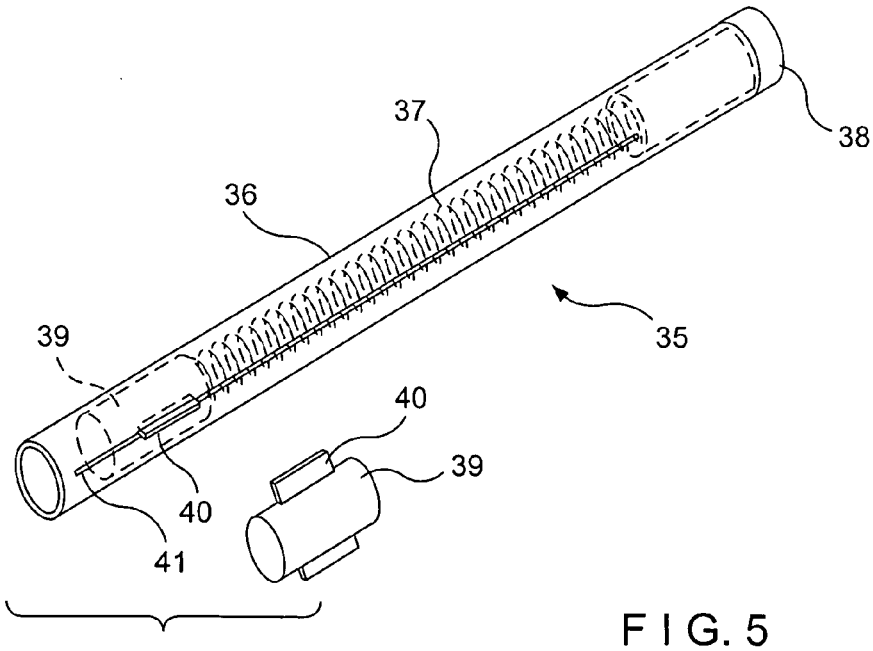
FIG. 5 is a sectioned view of the tube hammer for driving a fastener.

In a preferred embodiment of the invention, with reference to FIG. 5, the columns 27 are sized to accept a tube hammer 35 thereover. The tube hammer has a hollow cylindrical body 36 having a bore sized to slip over a column. A spring 37 is disposed within the body 36 resting against a plug 38, the spring biasing a driver 39 which is slidable within the body. The driver has wings 40 that extend through and ride within a pair of slots 41. The slots preferably extend toward the bottom of the tube just far enough to allow the driver to drive the nail to the top of the cylindrical column but no farther.

In operation, a fastener is located within the bore as described previously, and the tube hammer slipped over the column and fastener. Then grasping the wings of the driver, the user slides the driver back against the spring thereby compressing the spring. The wings are released so that the driver speeds down the tube and strikes the fastener. Typically, the fastener is fully driven with one or more strikes. This assures proper driving of the nail into the wall.

Figure 6:
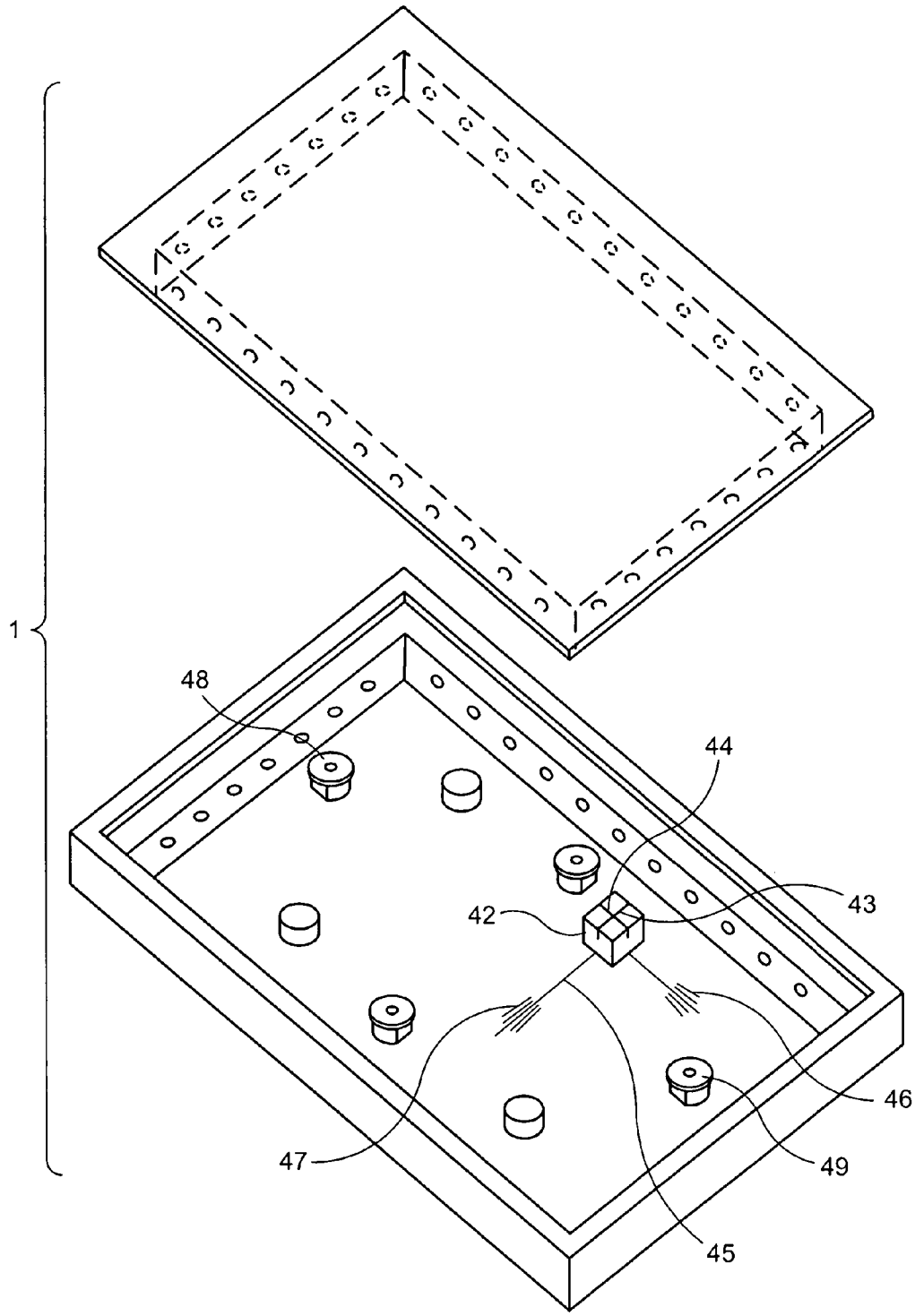
FIG. 6 is a view of the frame alignment system.

Referring to FIG. 6, the base contains at least one pillar 42, preferably having a square shape, with each side parallel to an edge of the base, if a square or rectangular base, or in parallel to a designated top and bottom if a round, oval or other shape frame. In other words, the square shape corresponds to a level condition when the sides thereof are perfectly vertical and horizontal, The pillar has cross-cuts 43 and 44 therein for a freely hanging plumb line 45. This is preferably separately included, so that it may be easily placed within either of the cross cuts by the user. Markings 46 and 47 are located on the base surface spaced away from but in coaxial alignment with the cross cuts.

In operation, the base is placed at the selected height and a first fastener driven substantially into the wall such as through column 48. After the first nail is placed, the end of a plumb line 45 is inserted into the cross cut 43 which is disposed along a vertical axis of the base. The base is adjusted, pivoting around the first fastener, until the plumb line is coaxial with the marking 47. At that point, the base is perfectly level, and the second fastener is driven such as through column 49 so that the frame is fixed perfectly straight on the wall. The plumb line should remain within the base, in case it is needed in the future, should the user wish to relocate the frame assembly. Optionally, the plumb line may have an arrow or other visual means for enhancing the visual alignment with the markings.

After the first frame is properly wall mounted, multiple frames may be aligned and spaced with precision using one of several provided alignment tools designed specifically for the inventive system.

Figure 7A:
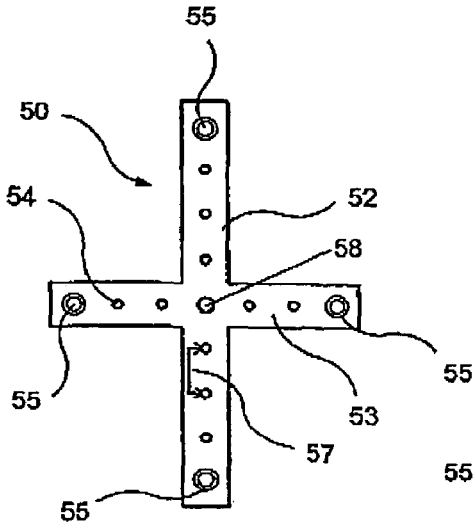
FIG. 7*a* is a view of an alignment tool for mounting multiple bases to a wall.
Figure 7B:
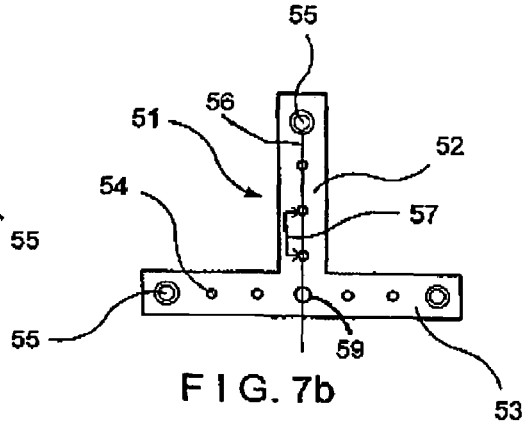
FIG. 7*b* a view of another tool for mounting multiple bases to a wall.

Referring to FIGS. 7*a* and 7*b*, a first alignment tool 50 is in the shape of a cross, and a second alignment tool 51 is in the shape of an inverted T. Each tool has right angle crossed members 52, 53 having uniform widths, generally being about two to four inches. Each member has a plurality of centered holes 54 through which light pencil markings may be made, and at the end of each member is located a connector 55 for receiving an end of a plumb line 56. Each member has markings 57 to identify a selected spacing and centering of frames of various sizes relative to each other. These markings may be length indications in inches or centimeters so that precise measured spacings can be achieved between the frames.

Figure 7C:
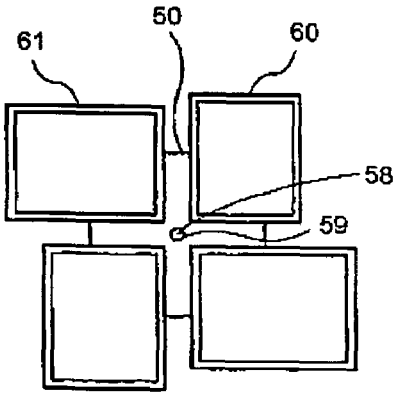
FIGS. 7*c* and 7*d* show the tools in use.
Figure 7D:
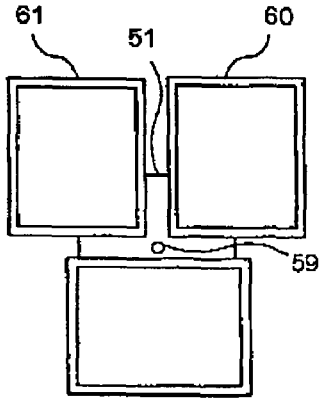

With reference to FIGS. 7*c* and 7*d*, a group arrangements of three and four frames respectively is shown. After choosing the group plan, the user measures and marks a focus spot 58 which is used to center the selected grouping. The alignment tool 50 has a center opening 59 that is aligned with the focus spot, placed over the spot 58 so that the spot remains visible through the centering hole. The user then connects the plumb line to the appropriate end connector 55 so that is hangs downward. The tool is then adjusted to assure that it is perfectly level, using guide markings on the tool, or by alignment with an opposite end connector. Holding the alignment tool in place, the user places a frame 60 in a corner opening formed by the crossed members of the alignment tool. The location of at least two of the sides of the first frame may then be marked with pieces of removable tape or with a light pencil line and then installed, or the base as discussed above may be simply held in place by the user, or another person, while it is installed. The next frame 61 is mounted by placing the alignment tool against the side or sides of the first installed frame or again using the centering hole and plumb line, and then placing the second frame against the opposite or adjacent side of the alignment tool. The second frame is thereby aligned and spaced correctly relative to the first frame and to each of the frames which will follow in the selected scheme. The process is repeated until all frames in the scheme have been installed. The tool 51 works in substantially the same way.

Figure 8:
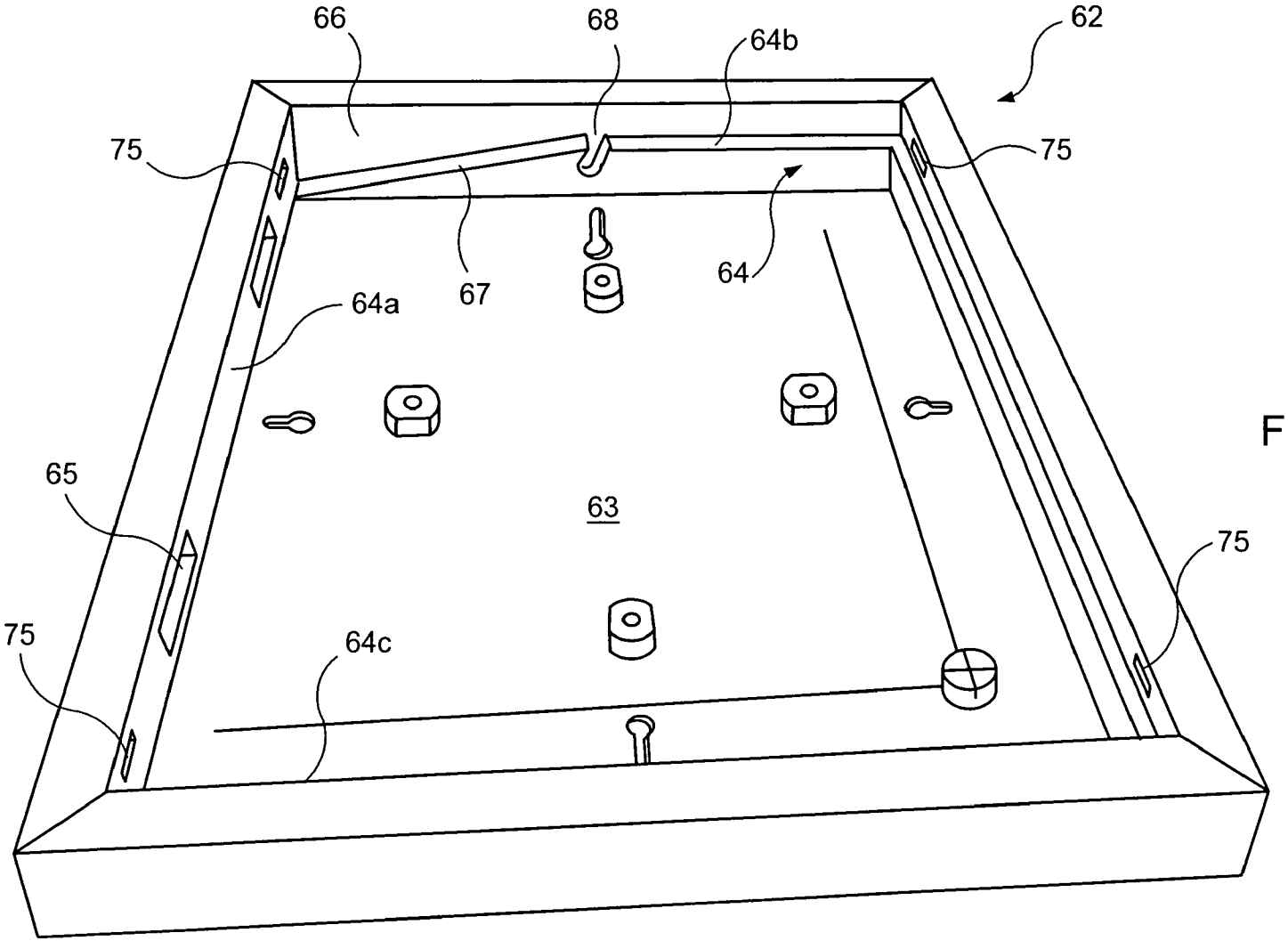
FIG. 8 is a view of an alternative embodiment of the picture frame base.
Figure 9:
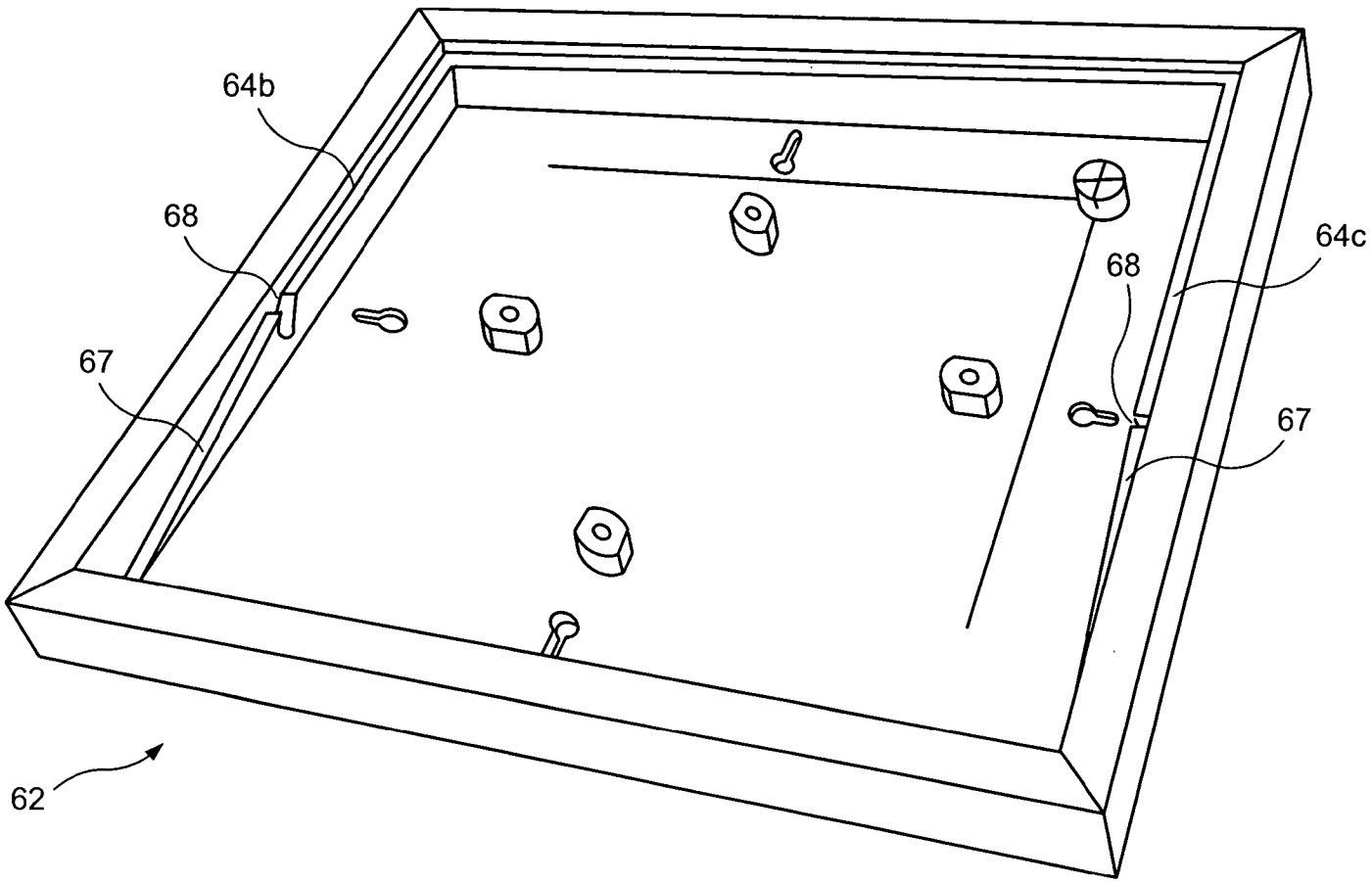
FIG. 9 is a rotated view of the picture frame base.

Referring to FIGS. 8 and 9, an alternative preferred embodiment of the present invention is shown which has a modified base-to-cover attachment arrangement. A base 62 has a bottom 63 surrounded by a side wall 64. On one side wall portion, 64*a*, one or more openings or depressions are provided. In this case two rectangular openings 65 are included. On a pair of opposed side wall portions 64*b* and 64*c*, adjacent the side wall portion 64*a*, the walls have an angled recess, 66 providing a ramped surface 67 sloping downward towards the side wall portion 64*a* and at the upper end having a socket 68. The recesses form receiving channels of a depth and size corresponding to mating structures on a cover, as will discussed below. The purposes of these structures will be described with reference to a cover 69.

Figure 10:
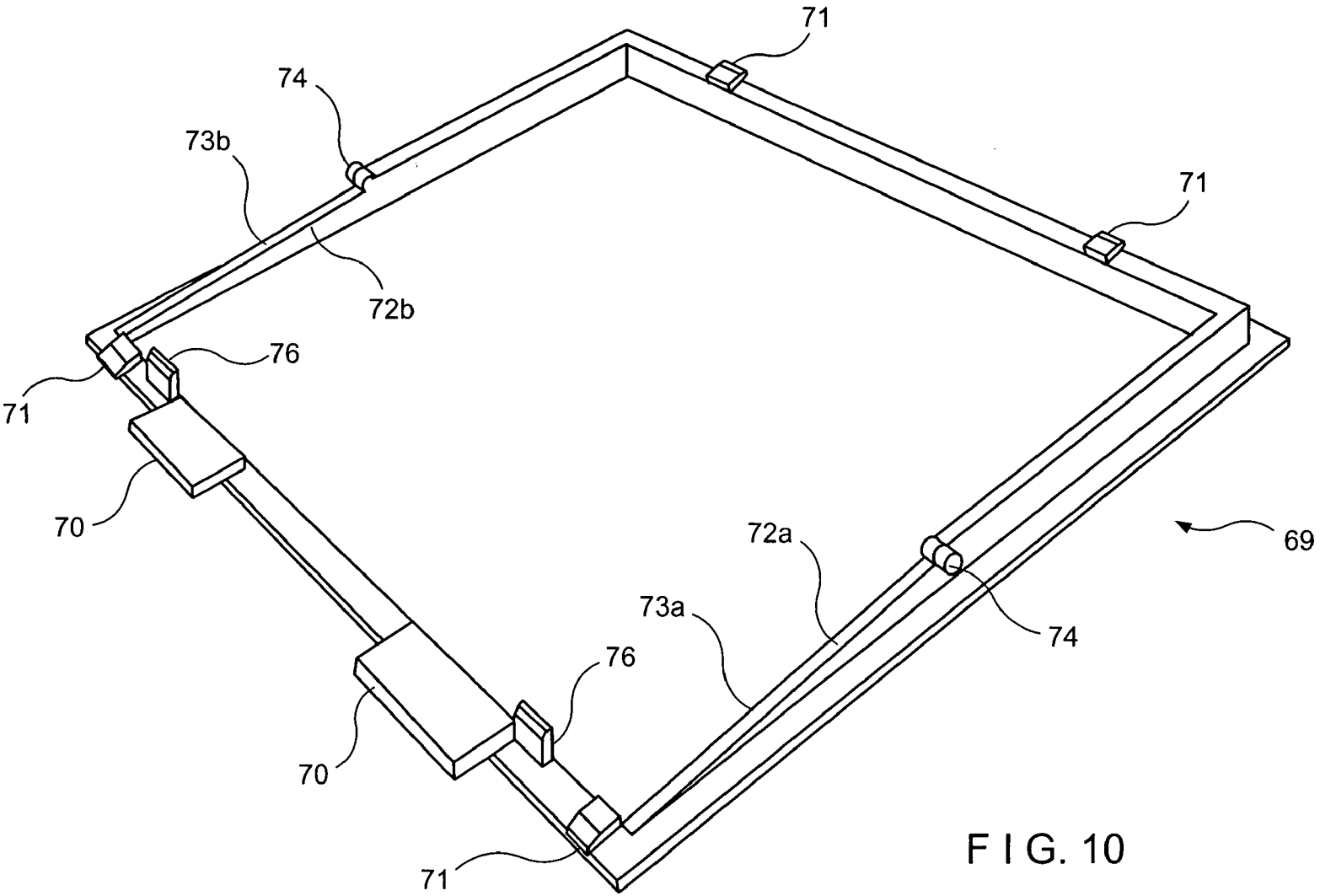
FIG. 10 is a view of the cover for the alternative embodiment of the invention.
Figure 11:
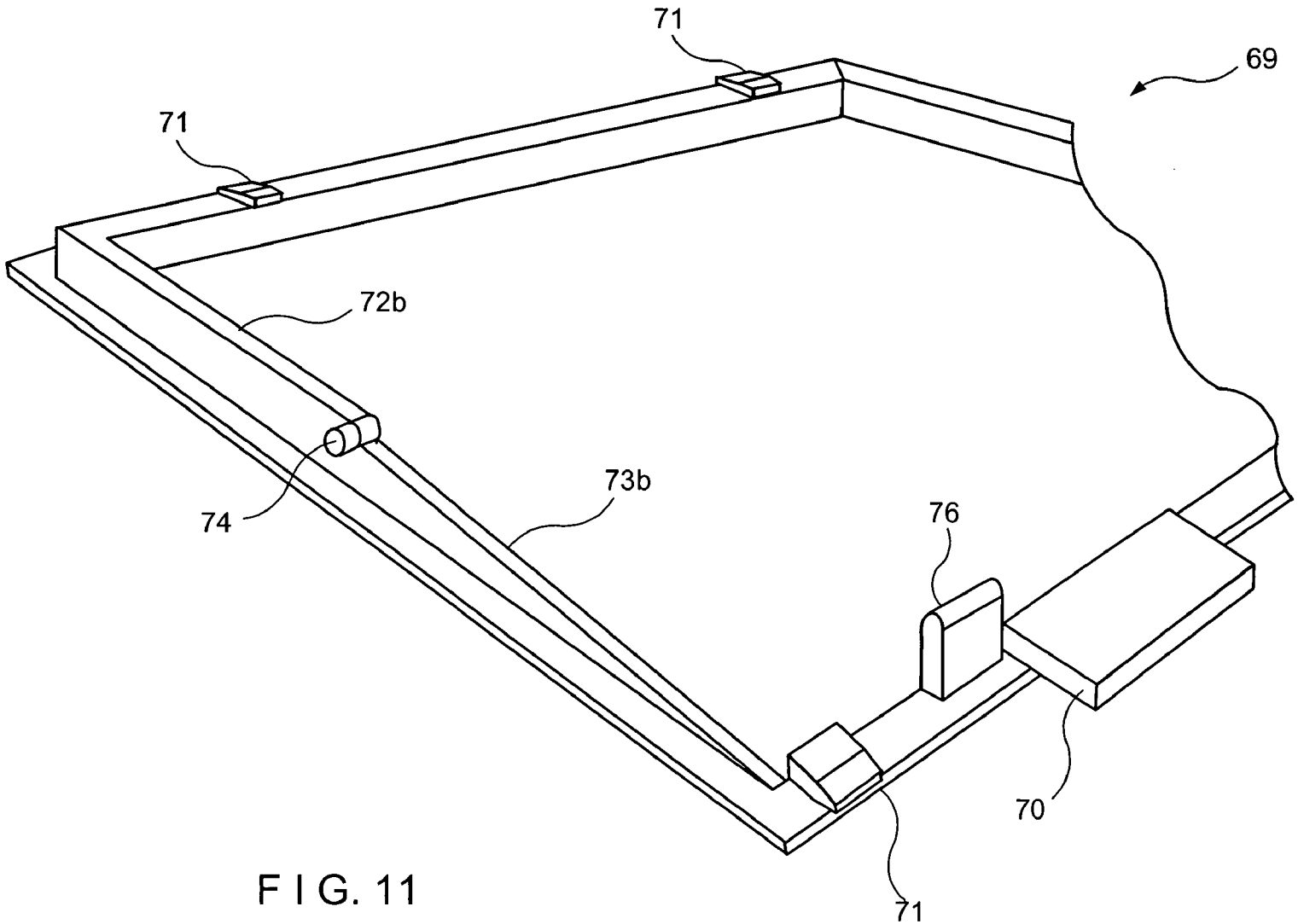
FIG. 11 is an enlarged partial side view thereof.

Referring to FIGS. 10 and 11, the cove 69 has a pair of tabs 70 located for mating to the openings 65. The cover has a pair of opposed side walls, 72*a* and 72*b* each of which has a ramped projection 73*a* and 73*b* leading to a locking lip 74, located for alignment and engagement with the sockets 68.

Figure 12:
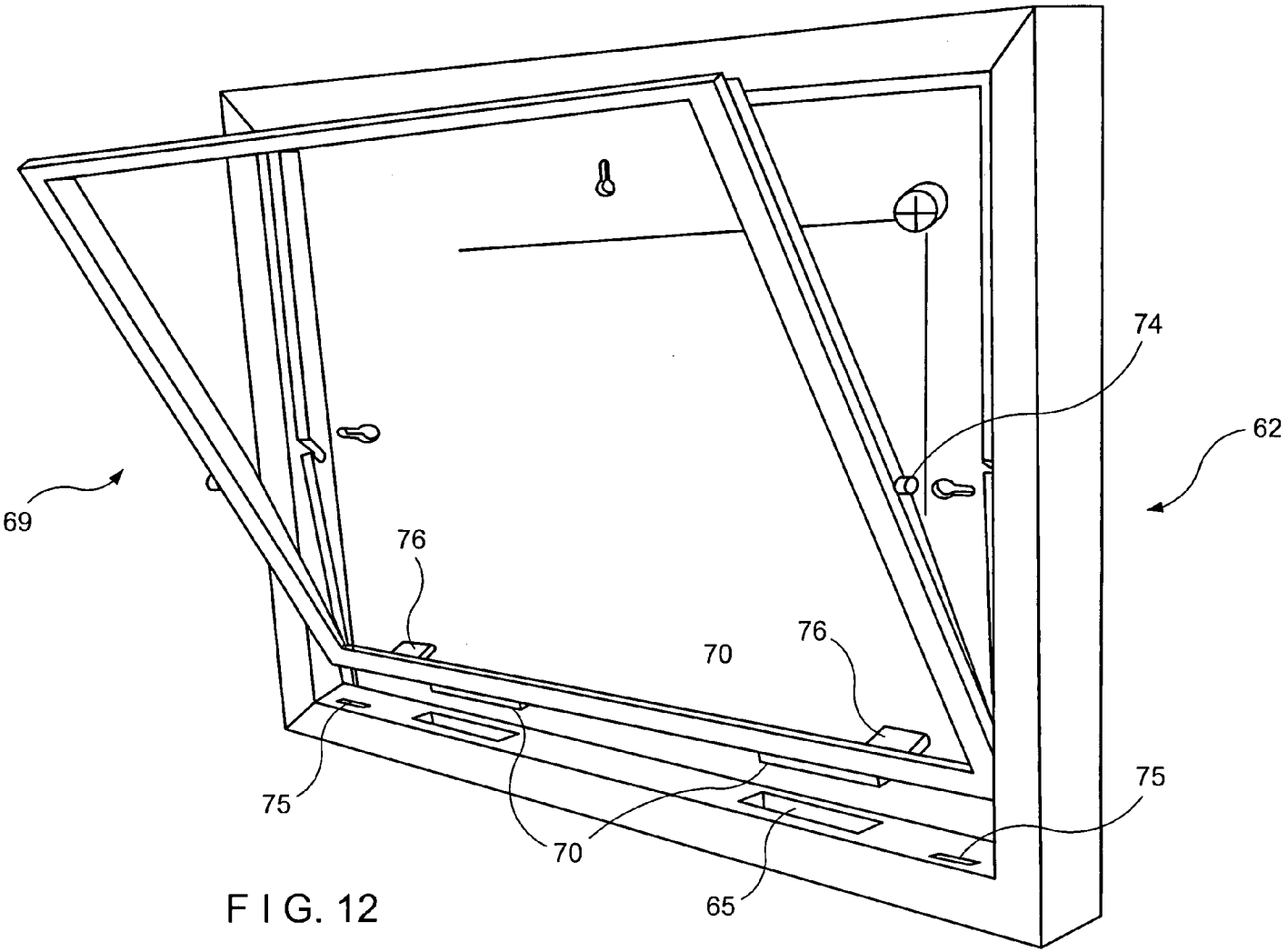
FIG. 12 is a view of the base and cover during engagement.

Referring to FIG. 12, the cover 69 has the guide tabs 70 first inserted into the corresponding openings 65 guiding the cover into proper alignment with the base at an angle. The cover is then gently pressed at its upper edges into the base. The ramped surfaces on the sides of the cover allow the lower portion of the cover to angle downwards into the interior of the base. As the top end of the cover is moved towards the top end of the base, the cover bottom rotates outward, the locking lips acting as a fulcrum when received in the corresponding sockets, which preferably, are slotted at a very slight angle in the downward direction so that the cover moves very slightly upwards when the lip engages the socket, and then downloads as the lip moves to the bottom of the socket. This angle also allows the cover to reside within the base, with the lips preventing the cover from falling out while the cover is being firmly pressed into place or when removed.

Continued slight pressure applied to the top edge of the cover moves the cover toward the top edge of the base, thereby causing the projections 71 to engage corresponding openings or depressions 75 on the base, as described relative to the previous embodiments. These projections are preferably located on the top and bottom of the cover, the top projections extend from the cover top, the bottom projections extending out slightly from an edge of the cover. These projections preferably have a beaded edge profile for providing a slight interference fit when received in the openings or depressions in the base to hold the cover when mated to the base. Preferably this allows the cover to "snap shut", the cover then having its top surface even with and level with the top surface of the base.

In this embodiment, the cover is held in place by the projections 71, locking lips 74 and the tabs 70, so as to provide a secure engagement.

Once closed, the cover may be "snapped open" and disengaged by slight pressure applied to the bottom edge of the cover, to cause the bottom of the cover to move inwards, releasing the top edge of the cover by this fulcrum effect, to ease removal. Thus, a relatively quick tilt engagement/disengagement is provided.

The cover has an inner ridge on three sides thereof for retaining an item to be displayed. The ridges extend along the top or bottom edge of the cover and partially down the adjacent sides, preferably extending for about three quarters of the length of the side wall, and are used to retain the displayed item within the cover. There may also be included other structures to hold the displayed item in the cover, as discussed relative to the previous embodiments, such as providing additional retaining tabs 76 along the bottom, sides or top of the cover. This embodiment, though described relative to what may appear as a "horizontal" mounting, can of course function as well for vertical mounting when turned 90 degrees.

If the frame assembly is to be used on a desktop or table top, a stand is added. Preferably, this is accomplished by fixing the stand to the back of the base. The stand is a plastic or cardboard-based pane of almost equal size to the back of the frame base, having a hinged and tethered pentagonal support and having two reinforced holes for insertion of fasteners, such as cotter pins, to fasten the stand to the base. Magnetic disks may also be attached to the back of the frame to allow magnetic mounting to a metal surface. The base back may optionally have one or more slightly sunken areas to receive magnets so as to rest flush with the metal surface. These sunken areas could also be used as seats for adhesive or Velcro disks as an alternative mounting method.

While a preferred embodiments of the present invention have been shown and described, it will be understood by those skilled in the art that various changes or modifications can be made without varying from the scope of the invention.

What is claimed is:

1. A picture frame assembly comprising:

a wall mountable base having means for receiving a cover assembly on a front portion thereof, the base having support means extending upwardly from a surface of the base, at least one pillar extending upwardly from the surface, at least one support means having a hole therethrough for receiving a fastener therein, the base having at least one set of vertical indicator means integral with the surface, plumb means connectable to the base in proximity to the vertical indicator means for leveling the base prior to fixing the base to the wall using the fastener;

the cover assembly having a border surrounding a transparent front surface and having a downwardly extending side wall received within the base, and means for removably holding a picture against the transparent front surface.

2. The picture frame assembly of claim 1 further comprising an upright wall extending about a periphery of the base for receiving and engaging the downwardly extending side wall.

3. The picture frame assembly of claim 2 wherein the upright wall has a plurality of projections for engaging the downwardly projecting side wall of the cover assembly.

4. The picture frame assembly of claim 2 further comprising at least one slot provided in a top surface of the upright walls, at least one slot provided in a corresponding location of the border such that when the cover assembly is received by the base the slots are in alignment, connector means fitted in the aligned slots for fixing the base to the cover sub assembly.

5. The picture frame assembly of claim 2 wherein the upright wall has a ramped surface means on a portion thereof, the cover assembly side wall having corresponding ramped surface means thereon.

6. The picture frame assembly of claim 5 wherein the upright wall has socket means thereon, the cover assembly sidewall having locking lip means engagable therewith.

7. The picture frame assembly of claim 5 wherein the base has at least one opening, the cover assembly having at least one tab receivable within the opening.

8. The picture frame assembly of claim 7 wherein the base has at least two openings, on a first side thereof, at least two ramped surface means disposed on sides perpendicular to the first side, and ramped downwardly towards the first side, for receiving at least two corresponding cover ramped surface means thereon.

9. The picture frame assembly of claim 1 wherein the pillar is a mounting block having means to receive an end of a plumb line disposed on the surface of the base in proximity to the vertical indicator means.

10. The picture frame assembly of claim 9 wherein the mounting block has at least one vertical slot for receiving an end of a plumb line therein.

11. The picture fume assembly of claim 1 further comprising a decorative frame border integral with the base.

12. The picture frame assembly of claim 1 further comprising a decorative frame border integral with the cover sub assembly border.

13. The picture frame assembly of claim 1 wherein the downwardly projecting side wall has a plurality of projections for engaging the base.

14. The picture frame assembly of claim 1 wherein the cover assembly is frictionally secured in the base.

15. The picture frame assembly of claim 1 wherein the cover assembly is releasably secured to the base by attachment means consisting of releasable fasteners, magnets and interlocking projection/indentation combinations.

16. The picture frame assembly of claim 1 wherein the at least one support means is substantially cylindrical.

17. The picture frame assembly of claim 1 wherein the at least one support means is substantially cylindrical and has a pair of opposed flat side surfaces, a fastener having a washer portion extending over an open area adjacent the flat side surfaces when received in the support means.

18. The picture frame assembly of claim 1 wherein the base has at least two supports means having holes therethrough for receiving fasteners therein.

19. The picture frame assembly of claim 1 further comprising a groove formed around a periphery of the base for receiving the downwardly extending side wall therein.

20. The picture frame assembly of claim 10 wherein the mounting block has a second horizontal slot therein.

* * * * *